US008841536B2

(12) United States Patent
Schnitman

(10) Patent No.: US 8,841,536 B2
(45) Date of Patent: Sep. 23, 2014

(54) MEDIA SYSTEM WITH PLAYING COMPONENT

(75) Inventor: Myles Schnitman, Rancho Santa Fe, CA (US)

(73) Assignee: Magnaforte, LLC, San Diego, CA (US)

( * ) Notice: Subject to any disclaimer, the term of this patent is extended or adjusted under 35 U.S.C. 154(b) by 0 days.

(21) Appl. No.: 12/606,153

(22) Filed: Oct. 26, 2009

(65) Prior Publication Data

US 2010/0186579 A1 Jul. 29, 2010

Related U.S. Application Data

(60) Provisional application No. 61/108,474, filed on Oct. 24, 2008.

(51) Int. Cl.

| | |
|---|---|
| ***G10H 1/08*** | (2006.01) |
| ***G10H 7/00*** | (2006.01) |
| ***G10H 1/00*** | (2006.01) |

(52) U.S. Cl.

CPC ..... *G10H 1/0025* (2013.01); *G10H 2220/005* (2013.01); *G10H 2210/125* (2013.01); *G10H 2240/135* (2013.01)

USPC ..... 84/625

(58) Field of Classification Search

USPC ..... 84/609, 625; 434/307 A

See application file for complete search history.

(56) References Cited

U.S. PATENT DOCUMENTS

| | | | | |
|---|---|---|---|---|
| 5,952,598 | A * | 9/1999 | Goede | 84/609 |
| 6,169,242 | B1 * | 1/2001 | Fay et al. | 84/609 |
| 6,281,420 | B1 * | 8/2001 | Suzuki et al. | 84/477 R |
| 6,822,153 | B2 * | 11/2004 | Comair et al. | 84/609 |
| 7,078,607 | B2 * | 7/2006 | Alferness | 84/609 |
| 7,519,832 | B2 * | 4/2009 | Herberger et al. | 713/189 |
| 7,525,036 | B2 * | 4/2009 | Shotwell et al. | 84/611 |
| 7,608,775 | B1 * | 10/2009 | Evans | 84/611 |
| 7,956,276 | B2 * | 6/2011 | Sako et al. | 84/625 |
| 8,112,474 | B2 * | 2/2012 | Miyoshi et al. | 709/203 |
| 8,115,090 | B2 * | 2/2012 | Miyajima et al. | 84/625 |
| 2001/0013123 | A1 | 8/2001 | Freeman et al. | |
| 2002/0065713 | A1 | 5/2002 | Awada et al. | |
| 2007/0149208 | A1 | 6/2007 | Syrbe et al. | |
| 2007/0239754 | A1 | 10/2007 | Schnitman | |
| 2007/0263069 | A1 | 11/2007 | Jendbro | |

(Continued)

OTHER PUBLICATIONS

PCT Notification of the International Search Report and the Written Opinion of the International Searching Authority dated Dec. 23, 2009, issued by the International Searching Authority/US, in connection with counterpart PCT application No. PCT/US2009/062130.

(Continued)

*Primary Examiner* — Jeffrey Donels

(74) *Attorney, Agent, or Firm* — Mintz Levin Cohn Ferris Glovsky and Popeo, P.C.

(57) ABSTRACT

This document describes a device for receiving and displaying graphical representations of digital music tracks and their components (in the form of digital interactive phrases, or "DIPs"). The device allows a user to play the music tracks using a new format, blend, mix or mash different music tracks together, via a digital interactive phrase process, and produce and listen to the blended, mixed or mashed digital music.

11 Claims, 9 Drawing Sheets

(56) References Cited

U.S. PATENT DOCUMENTS

| | | | |
|---|---|---|---|
| 2008/0004888 | A1 | 1/2008 | Davis et al. |
| 2008/0154714 | A1 | 6/2008 | Liu et al. |
| 2009/0037268 | A1 | 2/2009 | Zaid et al. |
| 2010/0076968 | A1 | 3/2010 | Boyns et al. |
| 2010/0262449 | A1 | 10/2010 | Monteforte et al. |
| 2010/0302056 | A1 | 12/2010 | Dutton et al. |
| 2012/0096490 | A1 | 4/2012 | Barnes, Jr. |
| 2012/0215640 | A1 | 8/2012 | Ramer et al. |

OTHER PUBLICATIONS

Non-Final Office Action dated Aug. 29, 2012, for U.S. Appl. No. 12/789,391.

Non-Final Office Action dated Sep. 21, 2012, for U.S. Appl. No. 12/789,420.

International Search Report dated Aug. 31, 2010, for related international application No. PCT/US2011/036491.

* cited by examiner (A)
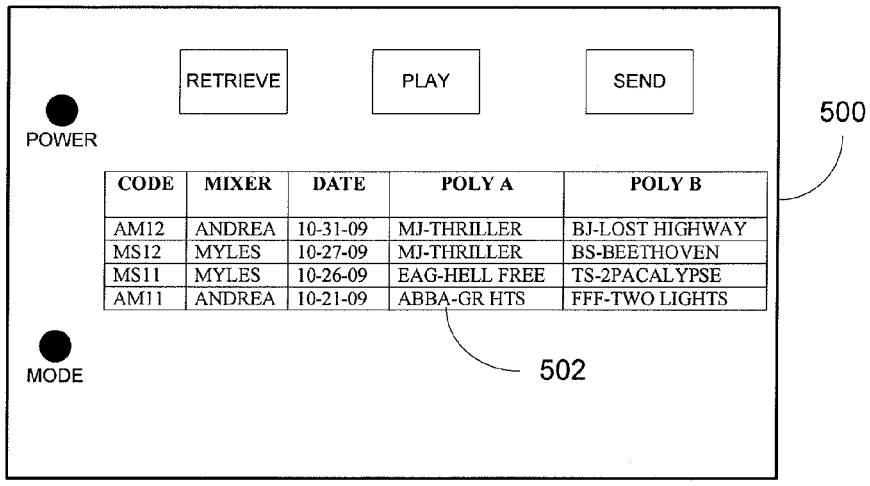
| CODE | MIXER | DATE | POLY A | POLY B |
|---|---|---|---|---|
| AM12 | ANDREA | 10-31-09 | MJ-THRILLER | BJ-LOST HIGHWAY |
| MS12 | MYLES | 10-27-09 | MJ-THRILLER | BS-BEETHOVEN |
| MS11 | MYLES | 10-26-09 | EAG-HELL FREE | TS-2PACALYPSE |
| AM11 | ANDREA | 10-21-09 | ABBA-GR HTS | FFF-TWO LIGHTS |
(B)
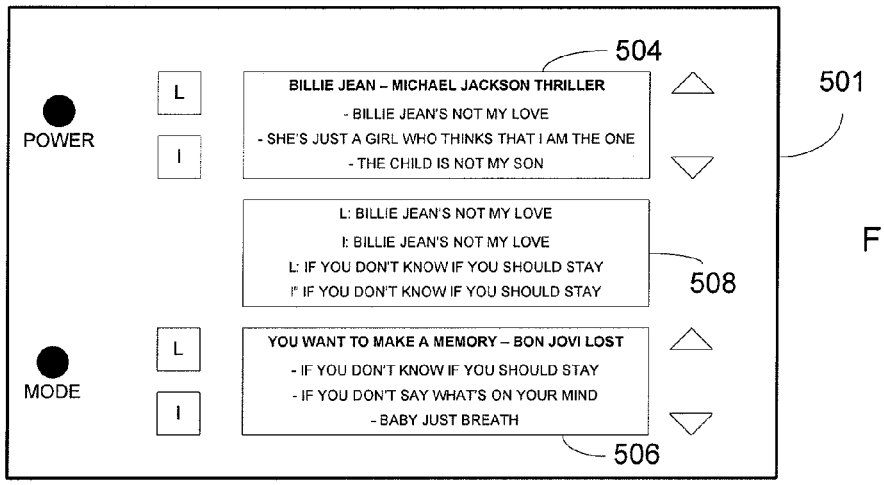
FIG. 8
(C)
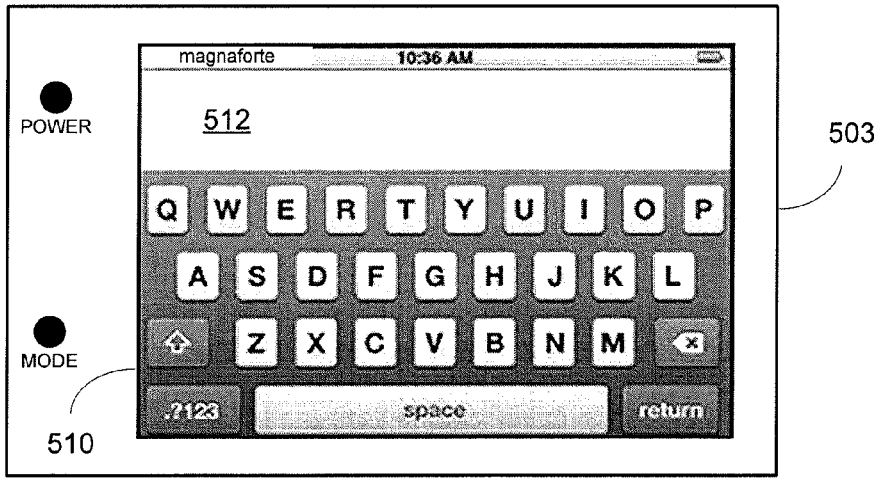

MEDIA SYSTEM WITH PLAYING COMPONENT

CROSS REFERENCE TO RELATED APPLICATIONS

This application claims the benefit of priority under 35 U.S.C. §119 to U.S. Provisional Patent Application Ser. No. 61/108,474, filed on Oct. 24, 2008, entitled, "MEDIA SYSTEM WITH PLAYING COMPONENT", the entire disclosures of which is incorporated by reference herein.

BACKGROUND

The media, in particular the music industry, has been confronted by a series of economic challenges. Technological advances and a faltering business model have led to a subservience to computer-based media markets, and a predominance of peer-to-peer music file sharing. Consequently, the core retail business of the music industry, for example, has been eroded. Despite various attempts by the music industry to correct, compensate for, or redirect music sales, the music industry has not been able to regain control of its retail market. Anti-piracy measures have failed and have led to further polarization of the industry and its market.

With regard to the music industry, the disparity between the average retail price of a conventional product, the music compact disc (CD) and the number of desirable tracks offered (usually only one to five tracks per CD) is having deleterious effects on the music industry business model. Therefore, a new business model has sprung up which provides an opportunity to effectively obtain by digital download (sometimes free), or even direct purchase of a select and limited number of tracks.

New digital media player devices have helped refocus the music industry to the new business model. Still, the overwhelming urge by consumers is to obtain their music for free, or at the lowest price possible. Further, these new media players and the networks by which music is distributed and downloaded only offer limited, discrete tracks which are sometimes accompanied by burdensome legal restrictions. The tracks can only be stored in their original state, unless modified by difficult-to-use and time consuming digital editing tools.

SUMMARY

This document describes a digital electronic system for recording, organizing, transmitting, manipulating, and reviewing digital files such as digital music files, in which the source data is not manipulated, but rather the sequencing of the source data is processed. In particular, this document presents a stand-alone electronic device for receiving and displaying graphical representations of digital music tracks and their components (in the form of digital interactive phrases, or "DIPs"), and which allows a user to play the music tracks using a new format, and to be able to blend, mix or mash different music tracks together, via a digital interactive phrase process. The device further allows the user to produce and listen to digital music of superior sequencing and sound fidelity.

In one aspect, a media device is disclosed. The media device includes a player device adapted to play, mix and store a plurality of discrete digital interactive phrases, and to display a representation thereof. The media device further includes a plurality of media components, each media component storing a set of the plurality of discrete digital interactive phrases, and having a physical and data exchange connection with the player device to transfer the digital interactive phrases to the player device for the playing, mixing and storing of the digital interactive phrases.

In another aspect, a method of processing and playing media files is presented. The method includes storing media source material as a plurality of digital interactive phrases on two or more media components having a housing that contains a memory and an electronic interface. The method further includes connecting at least two media components with a media device, the media device having a graphical user interface that displays the media source material from each of the connected media components. The method further includes combining user-selected digital interactive phrases from the at least two connected media components to form a new media file representing a mixed or mashed version of the user-selected digital interactive phrases.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

FIGS. 8A-8C illustrate several graphical user interfaces of the media system.

Like reference symbols in the various drawings indicate like elements.

DETAILED DESCRIPTION

This document describes a device for receiving and displaying graphical representations of digital music tracks and their components (in the form of digital interactive phrases, or "DIPs"). The device allows a user to play the music tracks using a new format, blend, mix or mash different music tracks together, via a digital interactive phrase process, and produce and listen to the newly sequenced, mixed or mashed digital music.

A DIP is any segment or phrase of a song containing instrumental music or lyrics, or a combination of music and lyrics. Combining a number of DIPS of any song or track can create a complete new version of that song or track. A DIP may be formatted in any of a variety of digital media formats. For example, a DIP can be formatted as a WAV file. Additionally, a DIP can be defined to include a musical phrase, a group of phrases, lyrics only, instrumental only, or a combination thereof. DIPs are preferably, though not necessarily, formatted as uncompressed data.

In implementations of the methods and systems disclosed herein, each DIP is encoded with a code according to which it can be mixed or mashed with one or more other DIPS. Each mix and mash code is a designation for a specific mix/mash of two specific song arrangements, and can be generated during mixing or mashing to enable playback and communication of the unique mix or mash. Alternatively, each code is generated specifically for each DIP in advance of any mixing or mashing. In specific implementations, the code requires less than 1 kbits of data. Codes can be individually distributed at no cost, and exchanged by email or other electronic networking means.

Figure 1:
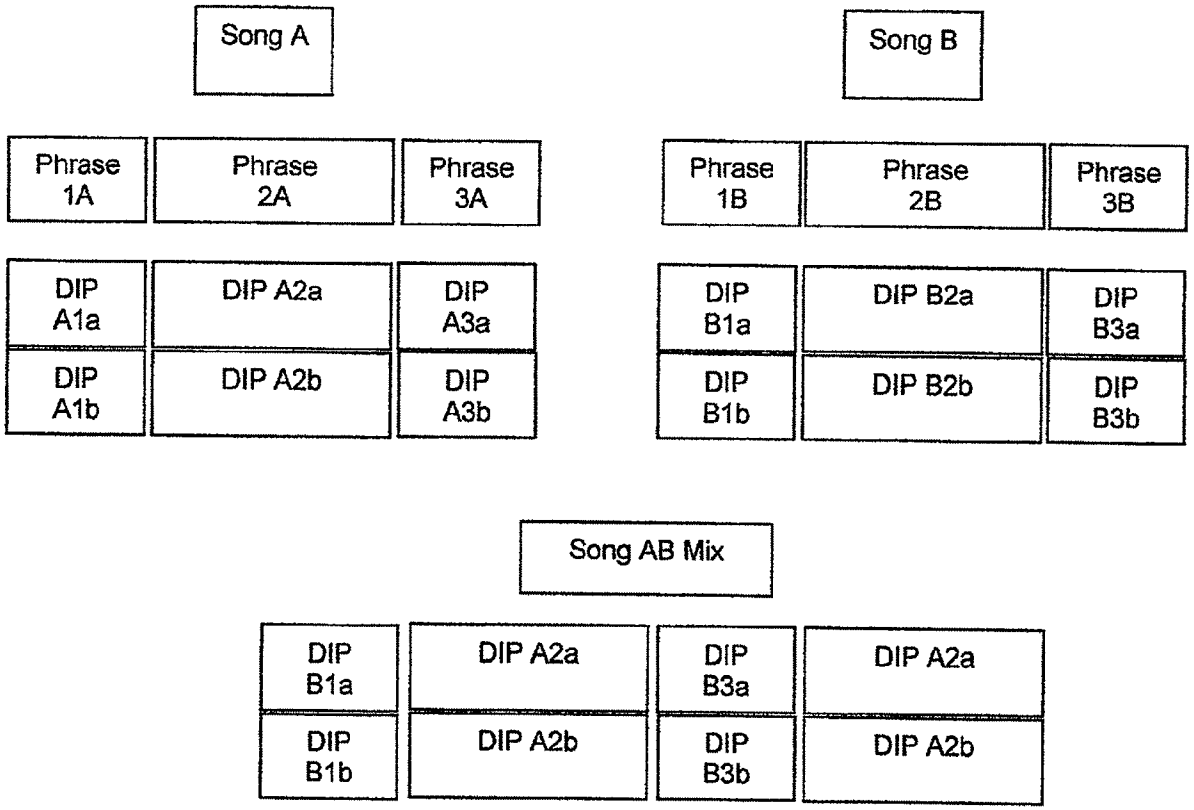
FIG. 1 illustrates a mix using the media system disclosed herein.

A "mix" is a combination of musical phrases, consisting of instrumental data and associated lyrics data, from different songs or different version of the same song, to create a new song. Mixing keeps lyric phrases and associated instrumental phrases together, but can contain more or fewer phrases than an original song. Mixed songs are defined by associated DIPS played in a specific order, and are known as a "vertical edit" as shown in an example in FIG. 1.

Figure 2:
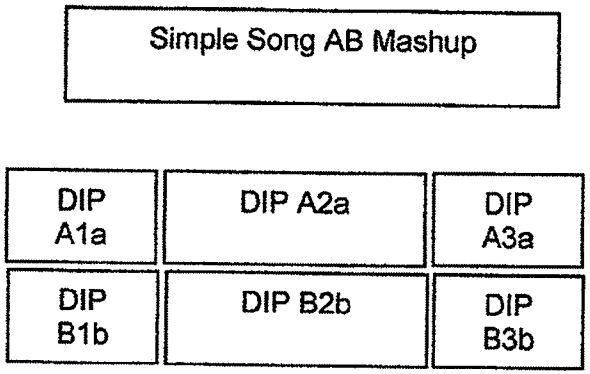
FIG. 2 illustrates a mashup using the media system disclosed herein.

A "mash" or mashup is a combination of some or all of a subset of the phrases of lyrics and/or rhythm from one song, with some or all of a subset of the phrases of lyrics and/or rhythm from another song, to create a new song. Mashes are assembled by combining DIPS, constructed from a given phrase, and containing lyrics and/or instrumental data, and played in a specific order. A simple mashup in which all encoded "a" DIPS from one song are combined, in sequence, with all encoded "b" DIPS from a second song, is also known as a "horizontal edit" as shown in FIG. 2.

In their final mixed or mashed form, DIPS can include normalization of their sound level to reduce, or even eliminate, discontinuity between phrases. Songs formatted as DIPS, whether mixed, mashed or original, can be stored and distributed on a media element, such as a poly (described below) or over a communications network.

In preferred implementations, the device includes a player device and two or more media components, each also known as a "poly". The media components are loaded with digital music tracks formatted and segmented as a series of DIPs, and are able to interface with the player device, independent of a computer or computer network, to enable playing of the series of DIPs to play a digital music track, or to enable mixing of DIPs among the two or more media components to produce new digital music tracks for playing or for sharing.

In one specific preferred implementation, the device includes two media components, selected from a large number of available media components, and each containing a maximum number of tracks. The media components are preferably sized and adapted for a unique form factor and have an electronic data communication interface that specifically connects to a corresponding interface of the player device. The two media components are adapted to be inserted or connected with the player device at the same time. Once inserted or connected to the player device, each media component transfers a list of its content to the player device, which in turn displays the list in a graphical user interface. The graphical user interface preferably includes a first region to display the list from a first media component, and a second region to display the list from a second media component, and so on. The graphical user interface further includes a third region for displaying a list of mixed DIPs from the first and second lists, as will be explained in further detail below.

A user is able to either play any given track selected from each individual media component through the player device, or alternatively sequence, mix or mash two different tracks, one from each media component or from two tracks of the same media component, if desired. The user combines the tracks in one of several ways: vertically "mixing" the lyrics or individual verses and musical phrases; or by horizontally "mashing" (which involves a process which separates the rhythm or beat from one track and combining them with the lyrics of another track. A DIP system is used for both the mixing and mashing process. The user is able to create an original track sequence, a custom mix of tracks, or other mixes as desired. DIPs are coded individually, and the codes are stored in a memory of each media component and transferred to the player device upon connection, or upon user command. Mix or mash codes can be retrieved once stored. Once retrieved, a mix or mash can be played from the mix or mash codes, provided the media components remain connected with the player device. The mix or mash codes can then be shared through email, by using a memory stick and/or providing a USB port on the device.

In preferred implementations, the player device can only play tracks or files from the inserted or connected media components, and the media components can only be connected to the player device, via proprietary interface, for retrieving and playing the content of the media components. In some implementations, each media component conforms to a standard size and shape, and made of a standard group of materials. For example, a media component can be formed as a squared, thin card (similar in form to a credit card). In other examples, the media component can have a three-dimensional form, or be rounded, and can be easily stored in one's wallet, purse or other carrying mechanism.

Each media component includes a maximum number of tracks, which can be listed in the player device as a list of tracks. Each track has been pre-annotated (typically by the recording entity or personnel) into musical segments known as the DIPs. Software in the player device deciphers and isolates the individual DIPs, and reveals the segmented DIPs on its graphical user interface. The player device is further configured to play the tracks from each or either media component in a seamless manner. Both the length and number of DIPs will vary with each track. Each DIP can be encoded with a standard, universal coding scheme that is recognized among a number of player devices, and which is used to identify each segment individually. Mixes or mash-ups can be exchanged by email, or via other media storage and porting technologies, such as through a Universal Serial Bus (USB) portable storage device.

Figure 3:
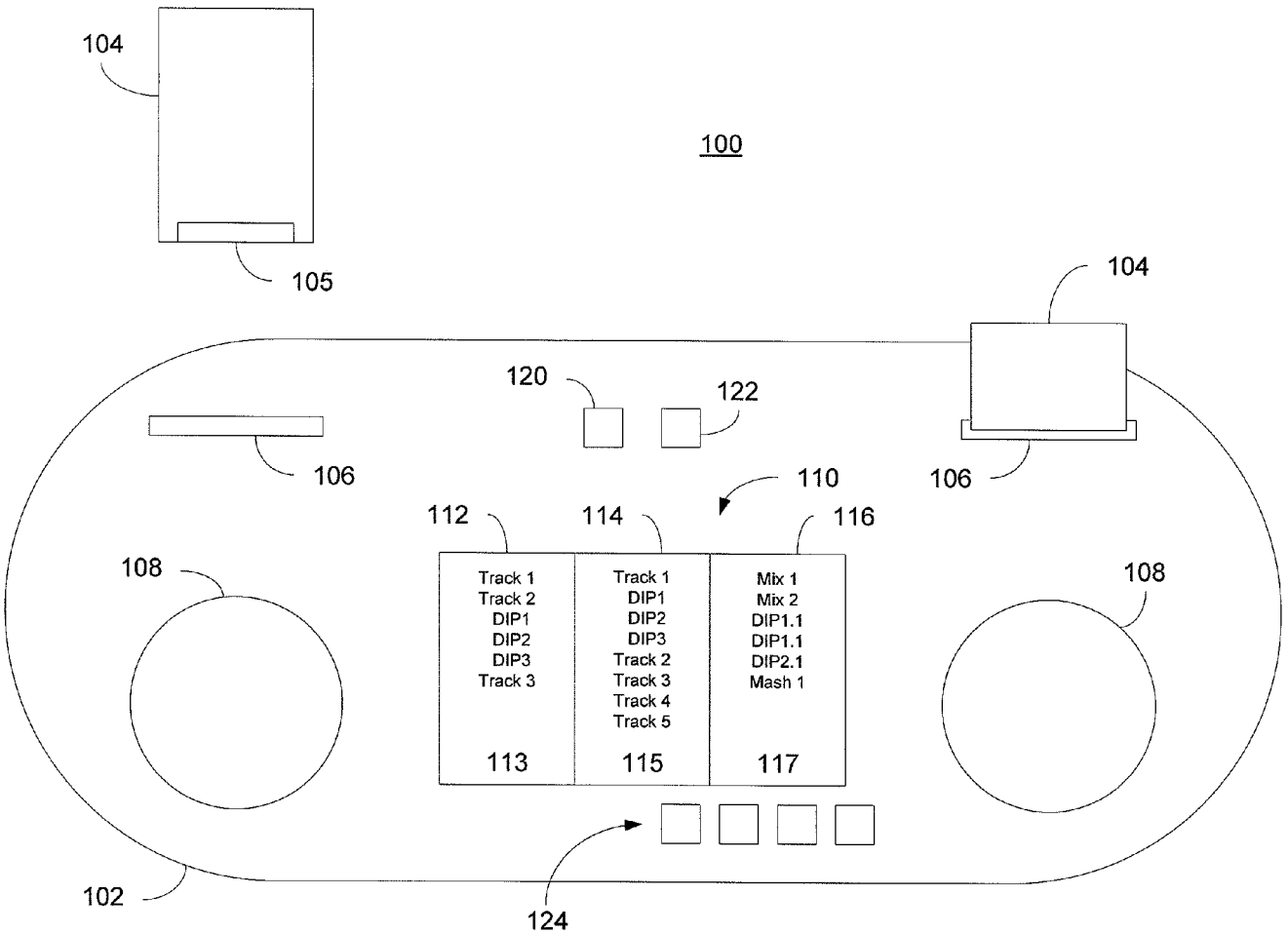
FIG. 3 is a general illustration of a media system

FIG. 3 is a general illustration of a media system 100 including a player device 102 and one or more media components 104. The media components 104 include a memory, such as solid state memory, for storing one or more digital files. The digital files can be in the form of music tracks or components thereof, and each file can be formatted into one or more discrete encoded DIPs. The media components 104 include a physical and electrical interface 105 that connects with a slot 106 or other type of receptacle in the player device 102. The interface 105 can include a number of electrical connections, and is preferably governed by an application programming interface (API) for transferring data back and forth with the player device 102.

The player device 102 preferably includes two or more slots 106 or other types of receptacles. The player device 102 further includes one or more audio speakers 108 arranged within the housing of the player component, and a graphical user interface (GUI) 110. In preferred exemplary implementations, the GUI 110 includes a first region 112 that displays a first list 113 of media files or DIPs from a first media component 104, a second region 114 that displays a second list 115 of media files or DIPs from a second media component 104, and a third region 116 that displays a third list 117 of mixed or mashed media files or DIPs taken from 112 and 114, which are generated by a user or imported from an external source.

The GUI 110 can be manipulated by a user to display commands or inputs. The GUI 110 is preferably a color display, and may include a touch-sensitive mechanism for manipulating and controlling various graphical elements within the display regions. For example, a user can "drag and drop" graphical or textual representations of files or DIPs from one region to another via tactile input, and the player device 102 will execute such input. Alternatively or concurrently, the user can manipulate a set of physical controls 124 such as a play button, stop button, forward, reverse, skip forward, skip backward, store, delete, etc. The player device 102 may also include an on/off control 120, and a volume control 122. It should be understood that the controls 124 can be physical buttons, touch-sensitive areas, or other graphical elements in the GUI 110.

The player device 102 plays one or more media components 104, and preferably two media components 104 at a time. The player device 102 plays DIPs and rearranged DIPs, while simultaneously highlighting the played DIPs on the GUI 110. The player device 102 operates under control and command inputs from a user to mix DIPs from multiple media components 104, to store mix codes, to play mixes and to import and export mix codes. The player device 102 can have both an active and dynamic mode, as well as one or more passive modes. In an active mode, a user actively creates mixes from two or more tracks. In a first passive mode, mix codes are imported through email, or directly mixed by a peer. In another passive mode, mix codes are imported from a playlist on a radio station website or other network connection.

Those having skill in the art will recognize that the size, shape, material, look and feel of the player device 102 can have many variations, and that the player device 102 depicted in FIG. 3 is for illustrative purposes only. The player device 102 and its functionality can also be implemented graphically by a computer on a graphical user interface (GUI) in a display device. In some implementations, functions of the player device 102 can be implemented in a distributed computing system, which functions can be executed and coordinated over a communications network.

Figure 4:
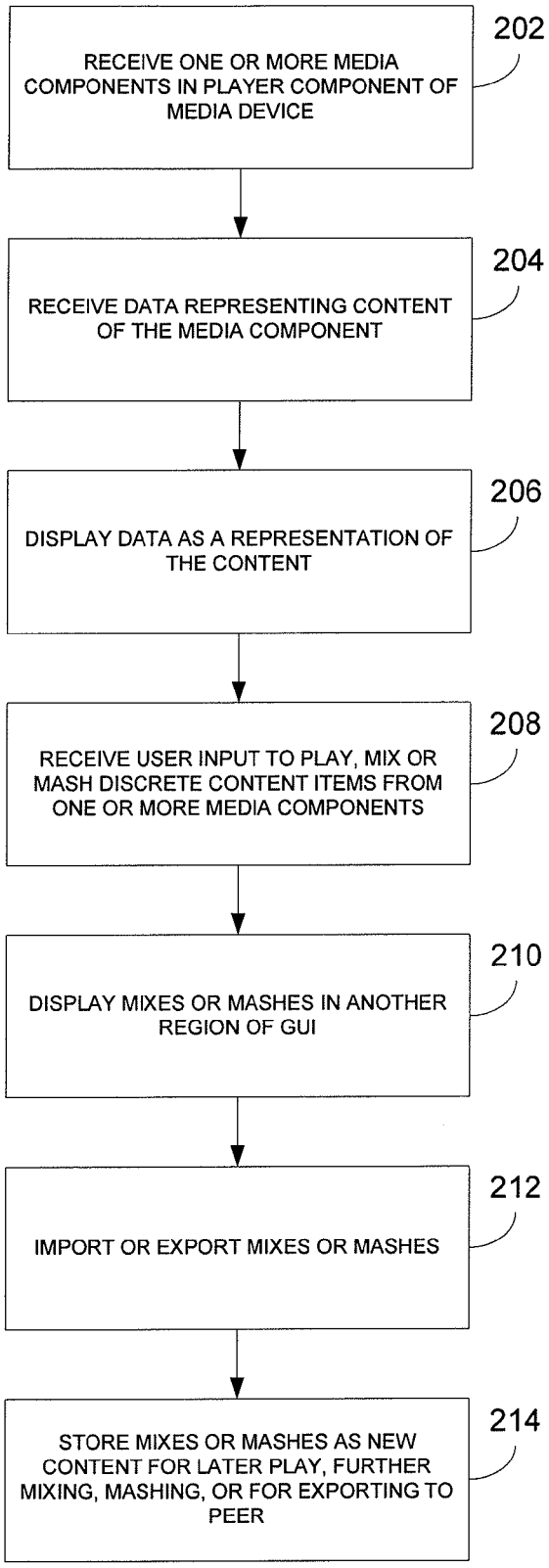
FIG. 4 is a flowchart of an operation of the media system.

FIG. 4 is a flowchart of a method 200 for operating a music mixing and mashing system. At 202, one or more media components are received in a player component of a media device. At 204, data representing content of the media component is received, preferably by the player component or by a computing system in communication with the player component and/or media device. At 206, the data is displayed as a representation of the content. At 208, user input as an instruction to play, to mix or to mash discrete content items from the one or more media components. The content items are preferably encoded DIPS, as described above.

At 210, content items are played, mixed or mashed according to the user input, and mixed or mashed content items can be displayed in another region of the GUI of the player component of the media device. The mixed or mashed content items form new content items that can be distributed electronically on a communications network, at 212, or be stored locally on the media device or on a media component at 214. The new content items as mixes or mashes can also be received or imported by the player component and/or media device.

In some implementations, a user plugs into an electrical outlet (or battery operated) and turns device on with a turn-on/off power button. The user can adjust the volume with the volume control. The user then inserts either one or two media components into the slots of the player device. In specific design implementations of the player device, one slot is located in the top left hand side of the player device, and the other slot is located in the top right hand side of the player device. There are four other controls: a) TRACK INDICATOR for a first media component, b) MIX button, c) MASH button, and d) TRACK INDICATOR for a second media component. Beneath each of these four controls, there is a corresponding GUI regions. The GUI is located in the front center of the player device, displaying three columns as regions, which illuminate graphical or alphanumeric representations of the content of the media components, i.e. tracks or DIPs, codes or other content.

Figure 5:
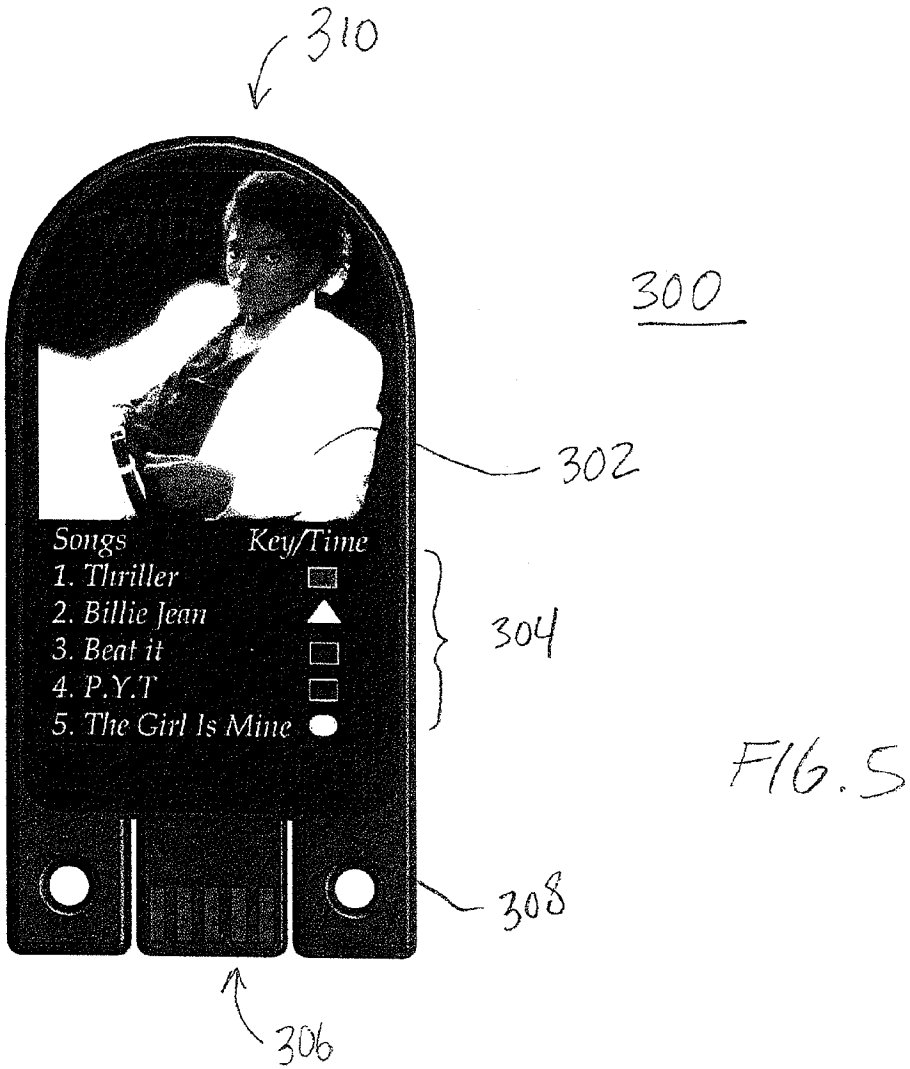
FIG. 5 illustrates one example of a media component.

FIG. 5 illustrates one example of a media component, also called a "poly" for purposes of this example. The poly 300 includes a graphical region 302 that shows the media content of the poly 300. The graphical region 302 can be a static display, or an electronic graphical display. The graphical region 302 can include, without limitation, a depiction of an album source from which the media content is provided, a list of media tracks or DIPS, and a key/time graphical representation 304 of key/time signatures of each media track or DIP. The key/time graphical representation 304 can include a number of color-coded shapes, in which the colors represent time characteristics and the shapes represent key characteristics, or vice versa. Other graphical representation schemes can also be used.

The poly 300 includes a microchip 306 that stores the media tracks or DIPS. The microchip 306 can be removable, or fixedly imbedded inside the poly 300 and communicatively accessibly by an electronic interface. The poly 300 can also include a number of holes 308 for being attached to a keychain, or for lockable storage in a carousel, for instance. The features of the poly 300 can all be contained or attached to a housing 310. The form of a poly 300 is preferably thin and card-like, and the housing can be plastic, nylon, metal, or other resilient or protective material. A poly 300 can be formed in any size or shape, but are preferably easily portable and are therefore preferably smaller than a typical compact disk (CD) encasement.

Figure 6:
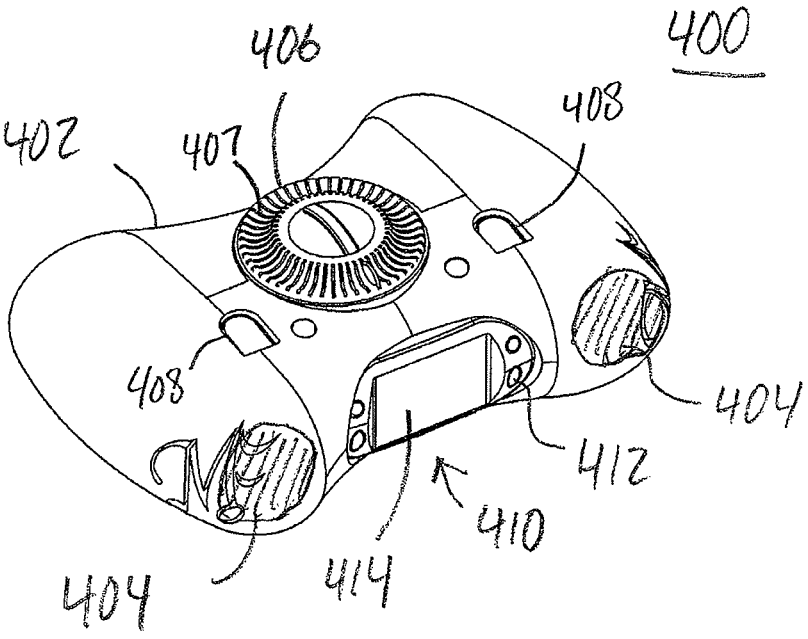
FIG. 6 depicts a media system in accordance with a specific implementation of the invention.

FIG. 6 depicts a media system 400 for mixing, mashing, managing and playing various media components. The media system 400 is contained within a housing form 402, and includes at least two high-fidelity stereo speakers 404. The media system 400 can also include a bass-driven subwoofer (not shown) or other speakers. The media system 400 further includes a media component physical storage 406, such as a carousel or other physical storage facility, which holds a number of media components 407, such as a number of polys described above. The media components 407 are accessible from the media component physical storage 406 for selective insertion or interfacing with one or more media component receptacles 408.

Figure 7A:
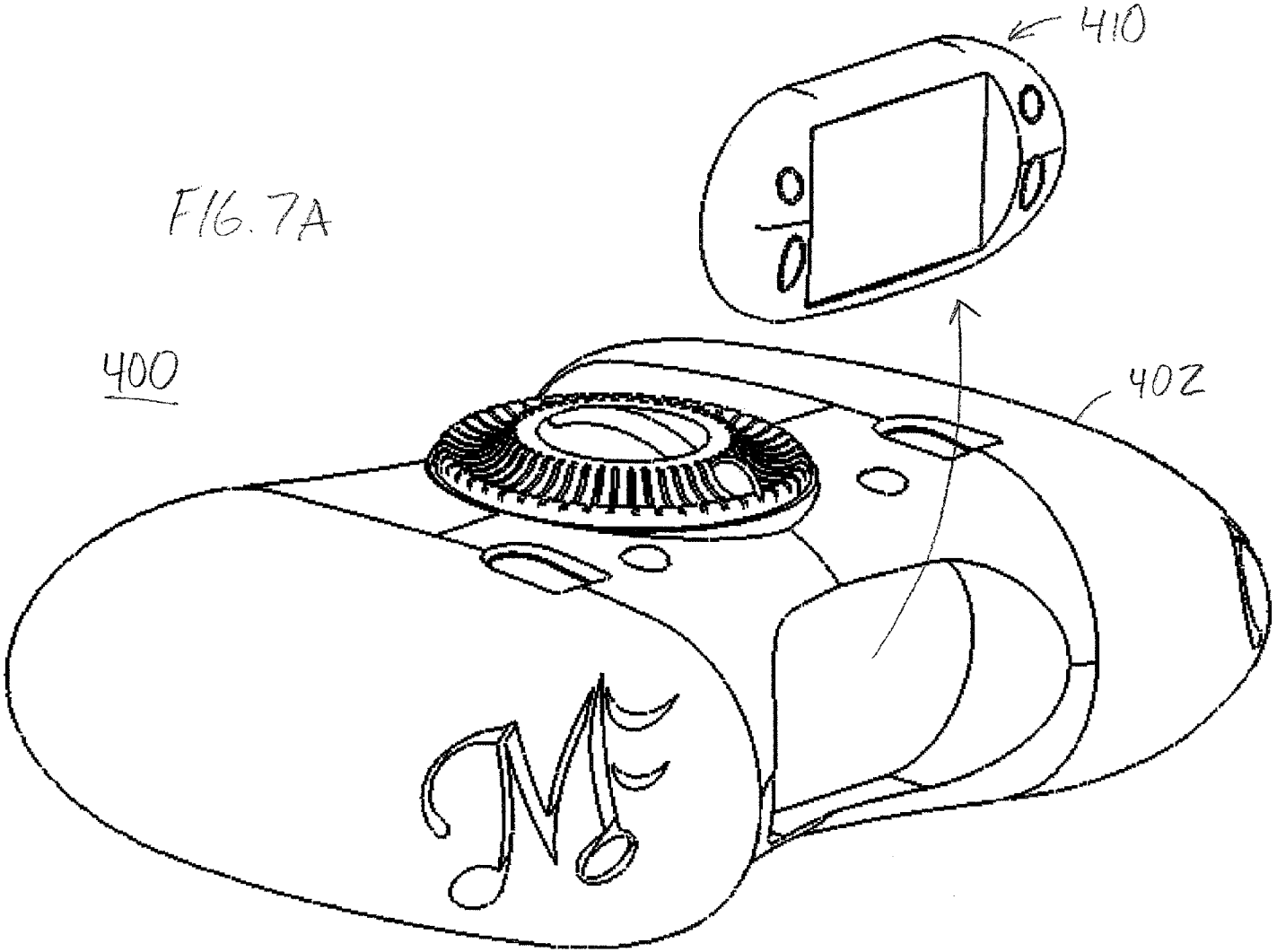
FIGS. 7A and 7B show various interface and media components of the media system.
Figure 7B:
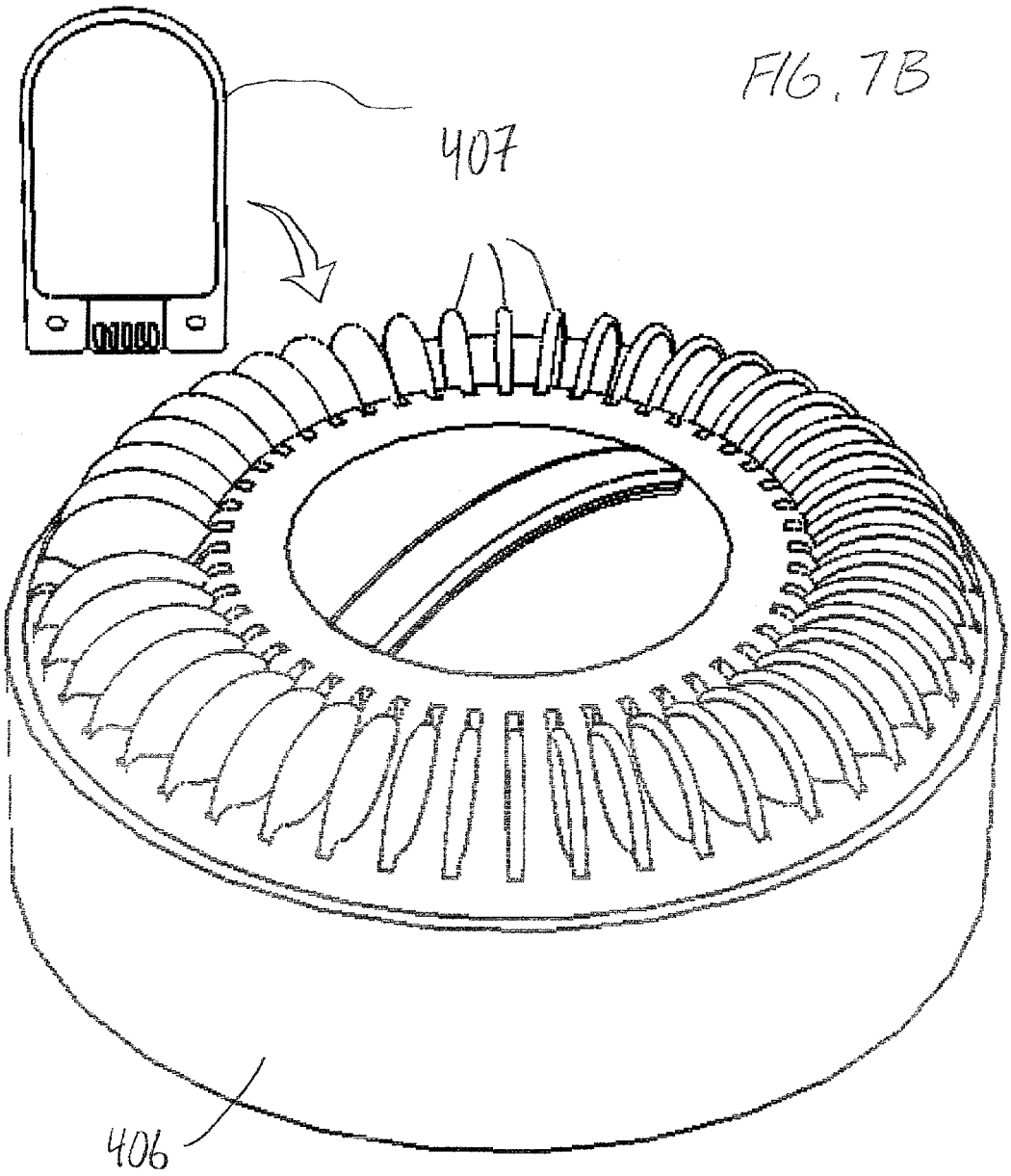

The media system 400 also includes a user control interface 410 that has a set of physical operation controls 412 and a graphical user interface 414. As shown in FIG. 7A, the user control interface 410 can be removable from the housing 402 of the media system 400. As shown by FIG. 7B, the media component physical storage 406 is also removable from the housing 402 of the media system 400, and can include slots for receiving single media components 407 so that user can organize and store their media components 407 in an structured manner.

The graphical user interface 414 of the user control interface 410 can display any number or types of graphical control screens. FIGS. 8A-8C show exemplary graphical control screens for controlling the operation of the media system 400. FIG. 8A shows a graphical control screen 500 that displays a playlist 502 of mixes that includes a code for each mix, a person who made the mix, a date, and a first poly and a second poly that were mixed together to form the mix.

FIG. 8B shows a graphical control screen 501 of the user control interface 410 that includes a list of DIPS from a first media source 504, a list of DIPS from a second media source 506, and a list of mixed DIPS 508 representing a mix of selected DIPS of the first and second list of DIPS. The graphical control screen 501 can include other user controls, such as a power control, a mode control, and scrolling buttons. FIG. 8C shows a graphical control screen 503 of the user control interface 410 that includes a qwerty alphanumeric keypad and an input box 512. All of the graphical control screens can be implemented as a graphical "touch" screen, as a set of hardware buttons, or a combination thereof.

In some implementations, a first region of the GUI displays a name of a first media component that is interfaced with the player device. A second region of the GUI displays a name of a second media component that is interfaced with the player device. Still other media components can be interfaced with the player device. The regions in the display can be arranged as a column of information. Alternatively, the regions can display icons or other graphical elements to represent tracks, DIPs or other components of the content. Arranged as a column, a region can display various detail about each content element: for example, it can display a name, artist, title, track number, DIP code, etc. At least one region can display codes or representations of the mixed or mashed DIPs.

Using a "drag and drop" mechanism with the GUI, a user creates a new sequence of coded DIPs, selected from at least one, and preferably two, regions in the GUI. The user can then initiate playback of any track number from either media component, playing a track as originally recorded, or playing the newly sequenced and encoded DIPs from the related region while simultaneously viewing the corresponding coded DIPs in the GUI.

To accommodate differences among the DIPs of tonal key and/or tempo, the present system can present a color-coded, shape-coded, or other graphical indication of a key and/or tempo type, such that two or more different DIPs can be mixed based on a similar key and/or tempo. The key identifies the tonic triad, the chord, major or minor, which represents the final point of rest for a piece, or the focal point of a section. The key is established via functional harmony: a sequence of chords leading to one or more cadences. A key may be major or minor. There are 12 major and 12 minor keys. The tempo, or "time signature" (also known as "meter signature") is a notational convention used in some musical notation to specify how many beats are in each measure and what note value constitutes one beat. Simple time signatures consist of two numbers, one above the other. The lower number indicates the note value which represents one beat (the "beat unit"). The upper number indicates how many such beats there are in a bar.

As described above with reference to FIG. 5 a graphical indication of a key/tempo type associated with each DIP can be displayed. Alternatively, the system can automatically adjust, in response to user input, the key and/or tempo of any selected DIP to accommodate mixing the DIP with any other selected DIP. In yet other implementations, the key of a song can be changed to make it more compatible with mixing and mashing. Or, the time (meter) signature of a song can also be changed to make it more compatible with mixing and mashing.

From at least one region in the GUI, a coded reference file is created in a database and stored. The user preserves mixes and mash-ups by enabling a "save" control, such as a button or other type of input mechanism. The user can send new sequences of codes of new mixes and mash-ups by email through using a USB port connected to a PC. The recipient of these new music codes can download and import into another player device, and purchase the same media components and input a command to that player device to bring up the codes as they were originally sent, and playback a mix as created by the sender.

By way of example, and with reference to the FIGS. 1-8, the following outlines a general method of operation of a media device ("musicator") and media components ("polys"):

1) User inserts two polys individually, in top loading apertures of musicator;

2) User selects two tracks to be mixed from the polys which are illuminated on the GUI;

3) Musicator recognizes title/artist/track selection from the encoding on each poly;

4) Musicator creates code file in data base;

5) User initiates playback of track in its entirety while simultaneously viewing the corresponding DIP code(s) on GUI while pre-annotated segments are being played;

6) User repeats process for second poly/track;

7) Using a touch screen drag and drop method of operation the consumer "drags" and "drops" DIPS (and associated codes) into a MIX column;

8) The transferred DIP in the MIX column is played;

9) The DIP is automatically cloned for repeated use on TRACK column;

10) If more than one DIP already has been dragged and dropped into MIX column, the proceeding DIP (above) in vertical arrangement is played first, followed by the newly proposed DIP (beneath) in vertical arrangement;

11) The entire mix may be played as it is being developed;

12) An alternate more expedient method is to drag and drop one of the two proposed music tracks into the MIX column and remove by drag and drop operation selective DIPS to be replaced by DIPS from the other proposed track;

13) Once the user has played the mix through its entirety and is satisfied with the sequence of DIPS in the MIX column (mix codes), a "Store" button is pressed, allowing for the storage of the mix for an indefinite time interval (until mix is chosen to be deleted, using a "Delete" button;

14) After a mix is stored, it can also be exported as an email via USB or other communication port connected to a computer having an email client program;

15) Mixed codes can also be imported automatically and selected mix codes stored for future playback provided respective musical tracks from respective polys are inserted in the musicator;

16) User can access a customized system for indexing mix codes for quick and easy identification retrieval;

17) The user can use a remote control device with GUI to allow for mixing/mashing from a remote location (i.e. across room);

18) Controls for Volume/Play/Fast Forward/Rewind, etc. are accessible via remote.

In accordance with the devices, systems and techniques described above, users can play and listen to music with a superior audio sound reproduction, and also mix music individually to customize tracks. The devices described herein are adapted to redirect music playing and processing from the computer industry where it can be easily downloaded and pirated, and returns it back to the music industry using a retail-oriented device and player device which requires users to purchase music played and used.

The implementations described in this document will help curtail the rampant piracy of music through peer-to-peer music file sharing over the Internet, as well as the unauthorized reproduction of musical CD's by the process of "burning" them. These implementations will also curtail the ability of users to download one individual track, thus bypassing altogether the purchase of numerous tracks contained in a given package, yet still retain and encourage peer-to-peer sharing of music. The device engages the consumer and enables the consumer to be creative, artistic, interactive, and original.

The player device and media components offer an enjoyable, viable system for the family, and because of their consumer-friendly configuration and ease of operation, allows users of all ages to play, listen, and mix or mash their own music. Through the use of standardized codes and a secure format, a "currency" can be created through which musical creations can be exchanged, and by which different musical genres can be cross-pollinated.

In other implementations, within a conference, such as in down-time before an official start of the conference, or to introduce the conference, a web server can insert messages such as advertisements as an audio stream into the voice network. Further, advertisements can be provided to the website associated with the teleconferencing system, as participants can both participate in the conference on their mobile devices or other telecommunication devices, as well as access a website associated with the conference to get additional information beyond the real-time voice transmissions.

Some or all of the functional operations described in this specification can be implemented in digital electronic circuitry, or in computer software, firmware, or hardware, including the structures disclosed in this specification and their structural equivalents, or in combinations of them. Embodiments of the invention can be implemented as one or more computer program products, i.e., one or more modules of computer program instructions encoded on a computer readable medium, e.g., a machine readable storage device, a machine readable storage medium, a memory device, or a machine-readable propagated signal, for execution by, or to control the operation of, data processing apparatus.

The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of them. A propagated signal is an artificially generated signal, e.g., a machine-generated electrical, optical, or electromagnetic signal, that is generated to encode information for transmission to suitable receiver apparatus.

A computer program (also referred to as a program, software, an application, a software application, a script, or code) can be written in any form of programming language, including compiled or interpreted languages, and it can be deployed in any form, including as a stand alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for executing instructions and one or more memory devices for storing instructions and data. Generally, a computer will also include, or be operatively coupled to, a communication interface to receive data from or transfer data to, or both, one or more mass storage devices for storing data, e.g., magnetic, magneto optical disks, or optical disks.

Moreover, a computer can be embedded in another device, e.g., a mobile telephone, a personal digital assistant (PDA), a mobile audio player, a Global Positioning System (GPS) receiver, to name just a few. Information carriers suitable for embodying computer program instructions and data include all forms of non volatile memory, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, embodiments of the invention can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Embodiments of the invention can also be implemented in a computing system that includes a back end component, e.g., as a data server, or that includes a middleware component, e.g., an application server, or that includes a front end component, e.g., a client computer having a graphical user interface or a Web browser through which a user can interact with an implementation of the invention, or any combination of such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

Certain features which, for clarity, are described in this specification in the context of separate embodiments, may also be provided in combination in a single embodiment. Conversely, various features which, for brevity, are described in the context of a single embodiment, may also be provided in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Particular embodiments of the invention have been described. Other embodiments are within the scope of the following claims. For example, the steps recited in the claims can be performed in a different order and still achieve desirable results. In addition, embodiments of the invention are not limited to database architectures that are relational; for example, the invention can be implemented to provide indexing and archiving methods and systems for databases built on models other than the relational model, e.g., navigational databases or object oriented databases, and for databases having records with complex attribute structures, e.g., object oriented programming objects or markup language documents. The processes described may be implemented by applications specifically performing archiving and retrieval functions or embedded within other applications.

Although a few embodiments have been described in detail above, other modifications are possible. The logic flows depicted in FIG. 4 do not require the particular order shown, or sequential order, to achieve desirable results. Other embodiments may be within the scope of the following claims.

The invention claimed is:

1. A media device comprising:

a player device adapted to play, mix, mash, and store audio content formatted as one of a plurality of discrete digital interactive phrases, each discrete digital interactive phrase encoded with a unique code and associated with one or more of an instrumental phrase and a lyrics phrase, and to display a representation thereof, the player device having one or more receptacles on a housing of the player device; and a plurality of media components that are insertable into and removable from one of the one or more receptacles, each media component storing a set of the plurality of discrete digital interactive phrases, and having a physical and data exchange connection with the player device when inserted into one of the one or more receptacles to transfer the discrete digital interactive phrases to the player device for the playing, mixing, mashing, and storing of the discrete digital interactive phrases, the player device being configured to:

create a mixed sequence by mixing the plurality of discrete digital interactive phrases in accordance with a first sequence while keeping the lyrics phrase and instrumental phrase of each discrete digital interactive phrase together, create a first reference file from the codes associated with the mixed plurality of discrete digital interactive phrases, create a mashed sequence by mashing the plurality of discrete digital interactive phrases in accordance with a second sequence by at least separating a first instrumental phrase from a first discrete digital interactive phrase, separating a first lyrics phrase from a second discrete digital interactive phrase, and combining the first instrumental phrase with the first lyrics phrase, create a second reference file from the codes associated with the mashed plurality of discrete digital interactive phrases, provide the mixed sequence to a user by transmitting the first reference file without the discrete digital interactive phrases associated with the mixed sequence, and provide the mashed sequence to the user by transmitting the second reference file without the discrete digital interactive phrases associated with the mashed sequence.

2. The media device in accordance with claim 1, wherein the player device includes a graphical user interface having a first region for displaying a representation of the plurality of discrete digital interactive phrases.

3. The media device in accordance with claim 1, wherein at least some of the plurality of media components comprise a memory circuit encased in a housing.

4. The media device in accordance with claim 1, wherein each of the plurality of discrete digital interactive phrases is encoded with a unique code.

5. The media device in accordance with claim 4, wherein each unique code is based on one or more of a set of musical characteristics that consists of: tone, tempo, key, time signature, and genre.

6. The media device in accordance with claim 1, wherein the player device further includes an input interface for receiving user input commands.

7. A method comprising:

storing media source material as a plurality of digital interactive phrases on two or more media components having a housing that contains a memory and an electronic interface, each digital interactive phrase encoded with a unique code and associated with one or more of an instrumental phrase and a lyrics phrase;

connecting at least two media components with a media device, the media device having a housing with one or more receptacles for receiving and connecting one of the two or more media components, the media device further having a graphical user interface that displays the media source material from each of the connected media components;

combining user-selected digital interactive phrases from the at least two connected media components to form a new media file representing a mixed sequence or a mashed sequence of the user-selected digital interactive phrases, the mixed sequence formed by at least:

mixing the user-selected digital interactive phrases in accordance with a first sequence while keeping the lyrics phrase and instrumental phrase of each user-selected digital interactive phrase together, and creating a first reference file from the codes associated with the mixed plurality of user-selected digital interactive phrases, the mashed sequence formed by at least:

mashing the user-selected digital interactive phrases in accordance with a second sequence by at least separating a first instrumental phrase from a first user-selected digital interactive phrase, separating a first lyrics phrase from a second user-selected digital interactive phrase, and combining the first instrumental phrase with the first lyrics phrase, and creating a second reference file from the codes associated with the mashed plurality of user-selected digital interactive phrases;

providing the mixed sequence to a user by transmitting the first reference file without the user-selected digital interactive phrases associated with the mixed sequence;

providing the mashed sequence to the user by transmitting the second reference file without the user-selected digital interactive phrases associated with the mashed sequence; and removing the at least two media components from the receptacles of the media device.

8. The method in accordance with claim 7, further comprising playing, using the media device, the new media file through at least speakers housed by the media device.

9. The method in accordance with claim 7, wherein each digital interactive phrase is a part of a digital audio file.

10. The method in accordance with claim 7, further comprising representing, in the graphical user interface, key and time characteristics of each digital interactive phrase.

11. The media device in accordance with claim 1, wherein at least one of the mixed sequence or the mashed sequence are provided to the user by e-mail.

* * * * *